US009561808B2

(12) United States Patent
Lehmann et al.

(10) Patent No.: US 9,561,808 B2
(45) Date of Patent: Feb. 7, 2017

(54) METHOD FOR CONTROLLING A MAGNETIC RAIL BRAKE DEVICE OF A RAIL VEHICLE

(71) Applicant: KNORR-BREMSE GESELLSCHAFT MIT BESCHRÄNKTER HAFTUNG, Mödling (AT)

(72) Inventors: Henry Lehmann, Hinterbrühl (AT); Peter Schlager, Kirchberg (AT); Bernhard Gross, Vienna (AT)

(73) Assignee: KNORR-BREMSE GESELLSCHAFT MIT BESCHRÄNKTER HAFTUNG (AT)

( * ) Notice: Subject to any disclaimer, the term of this patent is extended or adjusted under 35 U.S.C. 154(b) by 5 days.

(21) Appl. No.: 14/412,574

(22) PCT Filed: Jul. 3, 2013

(86) PCT No.: PCT/DE2013/000350

§ 371 (c)(1),
(2) Date: Jan. 2, 2015

(87) PCT Pub. No.: WO2014/005566

PCT Pub. Date: Jan. 9, 2014

(65) Prior Publication Data

US 2015/0183447 A1 Jul. 2, 2015

(30) Foreign Application Priority Data

Jul. 6, 2012 (DE) ..... 10 2012 013 520

(51) Int. Cl.
*B61H 7/00* (2006.01)
*B61H 7/08* (2006.01)

(52) U.S. Cl.
CPC ..... *B61H 7/08* (2013.01)

(58) Field of Classification Search
CPC .. B60T 7/128; B60T 8/17633; B60T 8/17613; B60T 13/748; B61H 7/08; B61H 7/083; B60L 7/00; B60L 7/28
(Continued)

(56) References Cited

U.S. PATENT DOCUMENTS 3,574,417 A * 4/1971 Howard ..... B60T 8/17633 303/119.2
3,653,329 A * 4/1972 Sasaki ..... B60L 7/28 105/184
(Continued)

FOREIGN PATENT DOCUMENTS

CN 1953894 A 4/2007
CN 101750218 A 6/2010
(Continued)

OTHER PUBLICATIONS

Search Report for International Patent Application No. PCT/DE2013/000350; May 9, 2014.
(Continued)

*Primary Examiner* — Pamela Rodriguez
(74) *Attorney, Agent, or Firm* — Barnes & Thornburg LLP

(57) ABSTRACT

A method for controlling a magnetic rail brake device of a rail vehicle, wherein the device contains at least one solenoid of a magnet rail brake, said solenoid being fed from a source of electrical energy via an electrical connection, wherein upon a magnet rail brake activation signal the electrical connection between the source of electrical energy and the at least one solenoid of the magnet rail brake is established and upon a magnet rail brake de-activation signal same is disconnected, in order to excite the at least one solenoid to generate a magnetic force or de-excite said at least one solenoid.

20 Claims, 2 Drawing Sheets

(58) Field of Classification Search
USPC ..... 188/41, 158, 159, 161, 163, 164, 165; 303/20, 123, 119.2, 168; 105/184, 185
See application file for complete search history.

(56) References Cited

U.S. PATENT DOCUMENTS

| | | | | |
|---|---|---|---|---|
| 3,881,578 | A * | 5/1975 | Dubreucq | B60T 13/748 188/165 |
| 3,937,525 | A * | 2/1976 | Luhdorff | B60T 8/17613 303/168 |
| 4,491,920 | A * | 1/1985 | Wood | B60T 8/17616 303/123 |
| 2014/0246277 | A1* | 9/2014 | Widl | B60L 7/006 188/41 |

FOREIGN PATENT DOCUMENTS

| | | | |
|---|---|---|---|
| CN | 102066172 | A | 5/2011 |
| DE | 10111685 | A1 | 9/2002 |
| DE | 102008059882 | A1 | 6/2010 |
| DE | 102010024686 | A1 | 12/2011 |
| DE | 102012014888 | A1 | 1/2013 |
| EP | 0370261 | A1 | 5/1990 |
| EP | 0724998 | A1 | 8/1996 |
| RU | 2275309 | C2 | 2/2005 |
| WO | 9954184 | A1 | 10/1999 |
| WO | 2009152983 | A2 | 12/2009 |

OTHER PUBLICATIONS

Written Opinion of the International Search Authority for International Patent Application No. PCT/US2013/000350, dated Jul. 3, 2013.

Chinese Office Action for Chinese Application No. 201380036007.2, dated Mar. 17, 2016.

* cited by examiner

METHOD FOR CONTROLLING A MAGNETIC RAIL BRAKE DEVICE OF A RAIL VEHICLE

PRIORITY CLAIM

This patent application is a U.S. National Phase of International Patent Application No. PCT/DE2013/000350, filed 3 Jul. 2013, which claims priority to German Patent Application No. 10 2012 013 520.3, filed 6 Jul. 2012, the disclosures of which are incorporated herein by reference in their entirety.

FIELD

Disclosed embodiments relate to a method for controlling a magnetic rail brake device of a rail vehicle, which device contains at least one solenoid of an electric magnetic rail brake, the solenoid being fed from a source of electrical energy via an electrical connection, wherein, upon a magnetic rail brake activation signal, the electrical connection between the source of electrical energy and the at least one solenoid of the magnetic rail brake is established and, upon a magnetic rail brake deactivation signal, the connection is disconnected, to excite the at least one solenoid to generate a magnetic force or de-excite the at least one solenoid, and also relates to a magnetic rail brake device of a rail vehicle, which device contains at least one solenoid of an electric magnetic rail brake, the solenoid being fed from a source of electrical energy via an electrical connection, and also an electronic control device, wherein, upon a magnetic rail brake activation signal triggered in the control device, the electrical connection between the source of electrical energy and the at least one solenoid of the magnetic rail brake is established and, upon a magnetic rail brake deactivation signal triggered in the control device, the connection is disconnected, to excite the at least one solenoid to generate a magnetic force or to de-excite the at least one solenoid.

BACKGROUND

Such a magnetic rail brake device is known for example from DE 101 11 685 A1. The force-generating primary component of an electric magnetic rail brake is the brake magnet. It is in principle an electromagnet consisting of a solenoid, which extends in the rail direction and is carried by a solenoid former, and a horseshoe-like magnet core, which forms the main body or carrier. On the side thereof facing the vehicle rail, the horseshoe-shaped magnet core forms pole shoes. The direct current flowing in the solenoid causes a magnetic voltage, which generates a magnetic flux in the magnet core, the magnetic flux short-circuiting via the railhead as soon as the brake magnet rests via the pole shoes thereof on the rail. The intermediate strip located in the space between the pole shoes and made of non-magnetic material prevents the magnetic flux from short-circuiting already via the pole shoes. Due to the magnetic flux short-circuiting via the railhead, a magnetic force of attraction is produced between the brake magnet and rail. Due to the kinetic energy of the moved rail vehicle, the magnetic rail brake is pulled along the rail via drivers. Here, a braking force is produced by the sliding friction between the brake magnet and rail in conjunction with the magnetic force of attraction.

Magnetic rail brakes are brought into the active state, in which the braking force is effective, by switching on the exciting current, that is to say by energizing the solenoid, or are brought into the deactive state, in which no braking force is effective, by switching off the exciting current, that is to say by de-energizing the solenoid. When switching the exciting current on and off, the magnetic rail brake applies the braking force suddenly or relieves the rail vehicle of the braking force suddenly, which involves an undesirable brake engagement jerk or brake release jerk respectively. Such a jerk poses a potential danger for the people travelling on the rail vehicle.

By contrast, disclosed embodiments develop a method and a device of the type mentioned in the introduction in such a way that the jerk when the magnetic rail brake is switched on or off is as low as possible.

DETAILED DESCRIPTION OF THE DISCLOSED EMBODIMENTS

Figure 1:
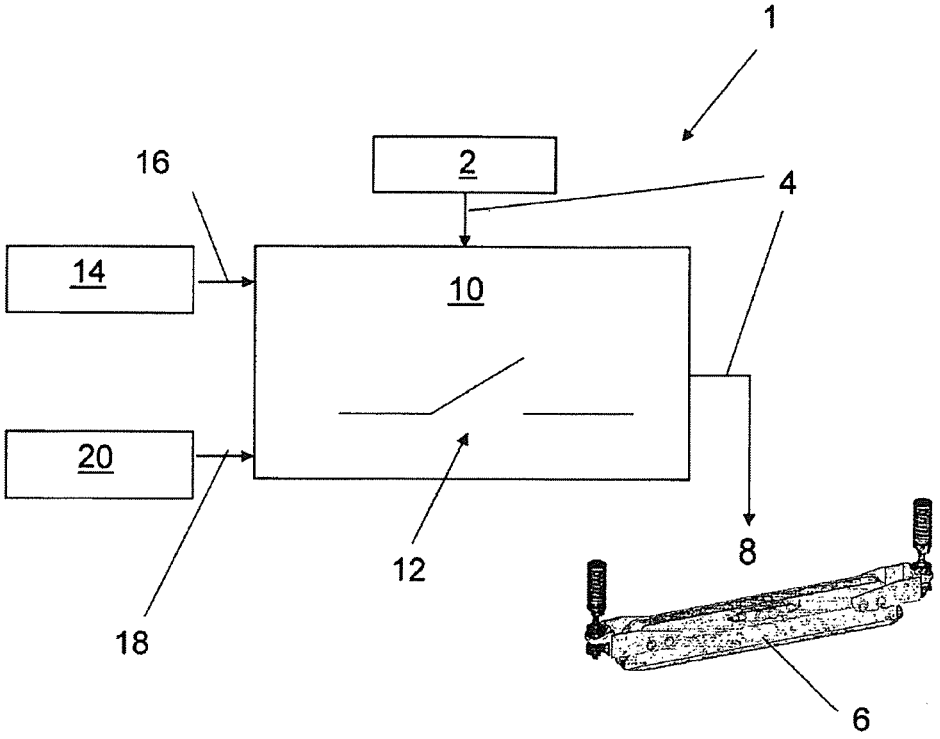
FIG. 1 shows a circuit diagram of a magnetic rail brake device in accordance with at least one disclosed embodiment.

Disclosed embodiments are based on the concept that upon the magnetic rail brake activation signal, the electrical connection between the source of electrical energy and the at least one solenoid of the magnetic rail brake, once established, is disconnected and re-established in a fixed sequence of cycles, to protect against the brake engagement jerk produced when the magnetic rail brake is switched on, or upon the magnetic rail brake deactivation signal, the electrical connection between the source of electrical energy and the at least one solenoid of the magnetic rail brake, once disconnected, is established and disconnected again in a fixed sequence of cycles, to protect against the brake release jerk produced when the magnetic rail brake is switched off.

Here, a "magnetic rail brake activation signal" is to be understood to mean a signal by which the magnetic rail brake is engaged in principle. By contrast, a "magnetic rail brake deactivation signal" is to be understood to mean a signal by which the magnetic rail brake is released in principle. The magnetic rail brake deactivation signal can also be formed from the negation of the magnetic rail brake activation signal, that is to say as soon as the magnetic rail brake activation signal is no longer present, the magnetic rail brake deactivation signal is generated or formed for the fundamental release of the magnetic rail brake.

In other words, the exciting current of the solenoid or the voltage applied to the solenoid is controlled over a defined course in the case of the fundamental switch from the activated state (magnetic rail brake activation signal) into the deactivated state (magnetic rail brake deactivation signal) or vice versa. This is implemented in each case by switching the exciting current of the solenoid off and on a number of times and for a short period, such that the exciting current and therefore the braking force reduces from the maximum value to zero in a delayed manner over a certain period of time. The switch-on/switch-off or connection/disconnection periods lie here in a range that can be achieved with conventional electrical or electronic switches. Due to the slower build-up or breakdown of the braking force of the magnetic rail brake compared with the prior art, the brake engagement jerk or brake release jerk is reduced, the efficacy of the method is particularly high if the magnetic rail brake is used until vehicle standstill, and the staggered disconnection of the exciting current is performed synchronously with the deceleration of the rail vehicle until vehicle standstill.

Whereas previously the use of a magnetic rail brake when braking until standstill was problematic due to the jerk in the event of the switch-on/switch-off, magnetic rail brakes can now also be used with the aid of the disclosed embodiments for braking until standstill, either exclusively or within the scope of brake blending together with other brakes, which leads to a shortening of the braking distance.

Due to the measures presented in the dependent claims, advantageous developments and improvements of the embodiments specified in the independent claims are possible.

Upon a fundamental magnetic rail brake deactivation signal, the exciting current is switched off and then switched on again by a switch over a defined period of time before the last and final switch-off moment of the magnetic rail brake, in which the rail vehicle for example has just come to a standstill, wherein the ratio between the disconnection periods, in which the solenoid is de-excited or separated from the source of electrical energy, and the connection periods, in which the solenoid is excited or connected to the source of electrical energy, may shift in the favor of the disconnection periods until the exciting current and therefore the braking effect practically reaches the value zero.

In other words, upon a fundamental magnetic rail brake deactivation signal, the disconnection periods, in which the electrical connection between solenoid and source of electrical energy is separated, may become longer over time, and the connection periods, in which this electrical connection is established, may become shorter.

Conversely, upon a fundamental magnetic rail brake activation signal, the disconnection periods, in which the electrical connection is separated, may become shorter over time, and the connection periods, in which the electrical connection is established, may become longer.

To avoid resonances, the period duration of each switch-off/switch-on or connection/disconnection cycle may be altered. The number of cycles is dependent on the inductance of the solenoid and on the desired period of time until activation/deactivation.

A speed signal representing the speed of the rail vehicle may be evaluated in respect of whether the speed of the rail vehicle, at the moment of generation of the magnetic rail brake activation signal or of the magnetic rail brake deactivation signal, is between a lower limit speed and an upper limit speed, and, if this is the case: the electrical connection between the source of electrical energy and the at least one solenoid of the magnetic rail brake, once established, is disconnected and re-established in the fixed sequence of cycles, and, if this is not the case: the electrical connection, once established, is maintained at least until standstill of the rail vehicle, or the electrical connection between the source of electrical energy and the at least one solenoid of the magnetic rail brake, once disconnected, is established and disconnected again in the fixed sequence of cycles, and, if this is not the case: the disconnection of the electrical connection, once disconnected, is maintained.

In other words, the method may be carried out in a speed range between a lower limit speed, this may also be equal to vehicle standstill, and an upper limit speed, because on the one hand a quick use of the magnetic rail brake is key at higher speeds above the upper limit speed, in particular if the magnetic rail brake is used for emergency or rapid braking of the rail vehicle. Then, maximum braking power is required, and the switch-on/switch-off of the magnetic rail brake is not performed. On the other hand, at speeds of more than 50 km/h for example as upper limit speed, a switch-on jerk occurring upon activation of the magnetic rail brake is relatively weak and therefore has little effect on comfort.

The electrical connection between the source of electrical energy and the at least one solenoid of the magnetic rail brake, once established, or the electrical connection between the source of electrical energy and the at least one solenoid of the magnetic rail brake, once disconnected, may be disconnected and re-established or established and disconnected again respectively in the fixed sequence of cycles over a predefined period of time.

In accordance with at least one disclosed embodiment, the periods of cycles of establishment of the electrical connection and the periods of cycles of disconnection of the electrical connection are constant in each case. Alternatively, the periods of cycles of establishment of the electrical connection and the periods of cycles of disconnection of the electrical connection could each be varied to avoid in particular a vibration excitation in the resonance range.

In accordance with at least one disclosed embodiment, upon the magnetic rail brake activation signal, the fixed sequence of cycles of disconnection and re-establishment of the electrical connection is performed only once. Similarly, and in one manner, upon the magnetic rail brake deactivation signal, the fixed sequence of cycles of re-establishment and disconnection of the electrical connection is performed only once.

Disclosed embodiments also relate to an Eddy current brake system of a rail vehicle, the system containing a magnetic rail brake device of the type described above.

The magnetic rail brake activation signal may be an emergency, rapid, enforced or service signal, that is to say the magnetic rail brake is activated within the scope of emergency, rapid or enforced or service braking (magnetic rail brake activation signal) or is deactivated following such emergency, rapid or enforced or service braking (magnetic rail brake deactivation signal).

To carry out the above-described method, a magnetic rail brake device as mentioned in the introduction is proposed, in which at least one switch is arranged in the electrical connection between the source of electrical energy and the at least one solenoid of the magnetic rail brake, the switch being actuated by an electronic control device in such a way that the above-described behavior of the magnetic rail brake is produced. Furthermore, at least one speed sensor for triggering a speed signal representing the speed of the rail vehicle is provided in the control device.

The exact course of the method for controlling a magnetic rail brake device and the exact construction of the magnetic rail brake device will become clear by the following description of an exemplary embodiment.

Disclosed embodiments are implemented in an electric magnetic rail brake device 1, in which the force-generating primary component is a brake magnet, which in principle is an electromagnet, consisting of a solenoid 6, which extends in the rail direction and is carried by a solenoid former, and a horseshoe-like magnet core, which forms the main body or carrier. On the side thereof facing the vehicle rail, the horseshoe-shaped magnet core forms pole shoes. The direct current flowing in the solenoid 6 causes a magnetic voltage, which generates a magnetic flux in the magnet core, the magnetic flux short-circuiting via the railhead as soon as the brake magnet rests via the pole shoes thereof on the rail. The intermediate strip located in the space between the pole shoes and made of non-magnetic material prevents the magnetic flux from short-circuiting already via the pole shoes. Due to the magnetic flux short-circuiting via the railhead, a magnetic force of attraction is produced between the brake magnet and rail. Due to the kinetic energy of the moved rail vehicle, the magnetic rail brake 8 is pulled along the rail via drivers. Here, a braking force is produced by the sliding friction between the brake magnet and rail in conjunction with the magnetic force of attraction. The general construction and the general operating principle of such magnetic rail brake devices have long been known, and therefore will not be discussed in greater detail.

In accordance with FIG. 1, the magnetic rail brake device 1 therefore has a solenoid 6 of a magnetic rail brake 8, the solenoid being fed from a source of electrical energy 2 via an electrical connection 4, and also has an electronic control device 10. Here, the electrical connection 4 between the source of electrical energy 2 and the solenoid 6 of the magnetic rail brake 8 is established upon a magnetic rail brake activation signal triggered in the control device 10 and is disconnected upon a magnetic rail brake deactivation signal triggered in the control device 10, to excite the solenoid 6 to produce a magnetic force or to de-excite the solenoid. The electrical connection 4 between the source of electrical energy 2 and the solenoid 6 of the magnetic rail brake 8 is produced by a corresponding electrical cabling 4.

Here, an electrical or an electronic switch 12 is arranged in the electrical connection or cabling 4 between the source of electrical energy 2 and the solenoid 6 of the magnetic rail brake 8 and is actuated by the control device 10 to establish or to disconnect the electrical connection 4 between the solenoid 6 and source of electrical energy 2. The switch 12 may be a relay, for example.

Furthermore, at least one speed sensor 14 for triggering a speed signal representing the speed of the rail vehicle is provided in the control device 10. To this end, an electrical signal line 16 is routed from the speed sensor 14 to the electronic control device 10.

The magnetic rail brake activation signal may be an emergency, rapid, enforced or service brake signal, that is to say the magnetic rail brake is activated within the scope of emergency, rapid, enforced or service braking or is deactivated following such braking. To this end, the electronic control device 10 is connected via a further electrical signal line 18 to a brake control plane 20, which for example obtains the command for activation or deactivation of the corresponding braking type via a safety loop or a vehicle data bus.

The control routines implemented in a memory of the control device 10 are designed here in such a way that the switch 12 arranged in the electrical connection 4 between the source of electrical energy 2 and the solenoid 6 of the magnetic rail brake 8 is actuated in such a way that, upon a magnetic rail brake activation signal, the electrical connection 4 between the source of electrical energy 2 and the solenoid 6 of the magnetic rail brake 8, once established, is disconnected and re-established in a fixed sequence of cycles.

In other words, upon a fundamental magnetic rail brake activation signal, for example within the scope of emergency braking, the electrical connection 4 is established by closing the switch 12, and the magnetic rail brake 8 is initially activated or engaged. The electrical connection 4 between the source of electrical energy 2 and the solenoid 6 of the magnetic rail brake 8, once established, is then disconnected and re-established in a fixed sequence of cycles, in each case by a corresponding actuation of the switch 12.

On the other hand, upon a fundamental magnetic rail brake deactivation signal, for example when an initiated braking or emergency braking is to be cancelled again on the whole, the electrical connection 4 between the energy source 2 and the solenoid 6 of the magnetic rail brake 8 is established and disconnected in a fixed sequence of cycles.

In other words upon a fundamental magnetic rail brake deactivation signal, for example to completely stop a process of emergency braking currently underway by opening the switch 12 or disconnecting the electrical connection 4, the magnetic rail brake 8 is firstly deactivated or released. The electrical connection 4 between the source of electrical energy 2 and the solenoid 6 of the magnetic rail brake 8, once disconnected, is established and disconnected in a fixed sequence of cycles, in each case by a corresponding actuation of the switch 12 by the control device 10.

This type of cyclical control of the magnetic rail brake 8 may be implemented in a speed-dependent manner, that is to say in a manner dependent on the speed of the rail vehicle at the moment of generation of the magnetic rail brake activation signal or magnetic rail brake deactivation signal, wherein the speed sensor 14 delivers a corresponding speed signal to the control device 10.

The control device 10 is designed to evaluate the speed signal to determine whether the speed of the rail vehicle is between a lower limit speed and an upper limit speed at the moment of generation of the magnetic rail brake activation signal or magnetic rail brake deactivation signal. Here, the upper limit speed is 50 km/h, for example.

If this is the case within the scope of the presence of a magnetic rail brake activation signal, the switch 12 is then actuated by the control device 10 in such a way that the electrical connection 4 between the source of electrical energy 2 and the solenoid 6 of the magnetic rail brake 8, once established, is disconnected and re-established in the fixed sequence of cycles. If this is not the case, the switch 12 is actuated by the control device 10 in such a way that the electrical connection 4, once established, is maintained and the magnetic rail brake 8 is thus held in a permanently engaged position, for example at least until standstill of the rail vehicle, If this is the case within the scope of the presence of a magnetic rail brake deactivation signal, the switch 12 is then actuated by the control device 10 in such a way that the electrical connection 4 between the source of electrical energy 2 and the solenoid 6 of the magnetic rail brake 8, once disconnected, is established and disconnected again in the fixed sequence of cycles. If this is not the case, the switch 12 is actuated by the control device 10 in such a way that the disconnection of the electrical connection 4, once disconnected, is permanently maintained and the magnetic rail brake 8 thus remains released.

The electrical connection 4 between the source of electrical energy 2 and the solenoid 6 of the magnetic rail brake 8, once established, or the electrical connection 4 between the source of electrical energy 2 and the solenoid 6 of the magnetic rail brake 8, once disconnected, may be disconnected and re-established or established and disconnected again respectively in the fixed sequence of cycles over a predefined period of time. This fixed period of time is measured here from the moment of generation of the magnetic rail brake activation signal or magnetic rail brake deactivation signal.

The cycles of the switch-on/switch-off or connection/disconnection can also be carried out alternatively without a time limit, in such a way that a mean current in a range from 10% to 90% of the nominal current of the magnetic rail brake is set. With cycles having no time limit, the cycle ratio and the period can vary relative to one another in a relation such that the mean current remains constant, but resonance frequencies are avoided.

Furthermore, upon the magnetic rail brake activation signal, the fixed sequence of cycles of disconnection and re-establishment of the electrical connection can only be performed once. Similarly, the fixed sequence of cycles of re-establishment and disconnection of the electrical connection may only performed once upon the magnetic rail brake deactivation signal.

Figure 2:
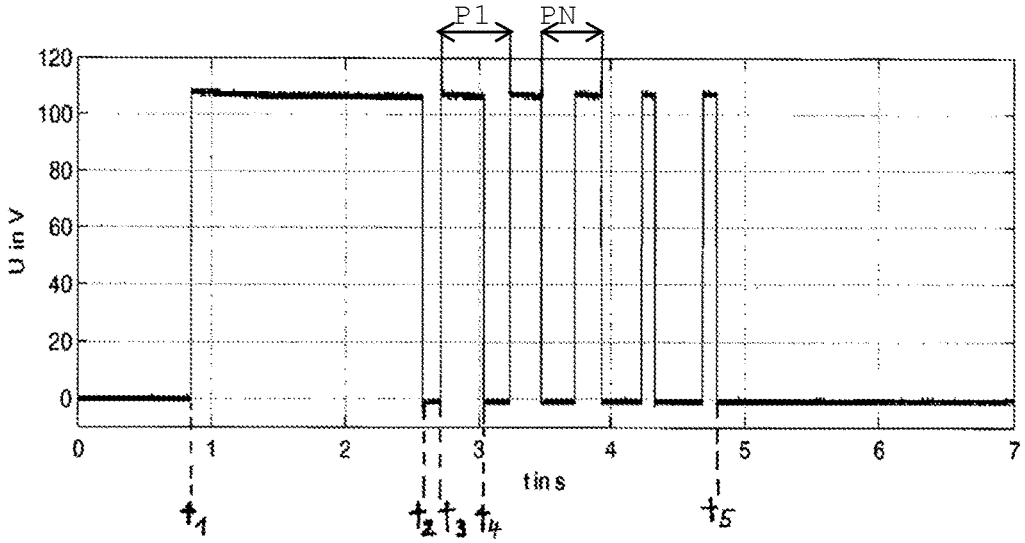
FIG. 2 shows a voltage/time graph, which illustrates the course over time of a voltage applied to a solenoid of the magnetic rail brake device of FIG. 1.
Figure 3:
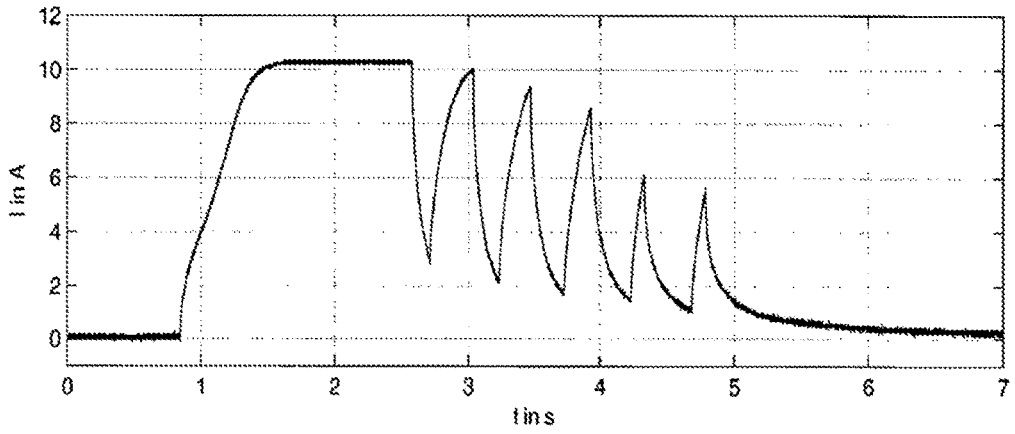
FIG. 3 shows a current/time graph, which illustrates the course over time of the exciting current of the solenoid of the magnetic rail brake device of FIG. 1.

FIG. 2 shows a voltage/time graph, which shows the course over time of a voltage applied to the solenoid 6 of the magnetic rail brake 8 of FIG. 1 when the solenoid 6 is excited or de-excited as described above. FIG. 3 shows the corresponding current/time graph, which illustrates the resultant course over time of the exciting current of the solenoid 6.

As a starting point, it is assumed in the case of this example that the speed of the rail vehicle equipped with the magnetic rail brake device is greater than the lower limit speed of approximately 5 km/h and is also greater than an upper limit speed of approximately 50 km/h, such that the speed sensor 14 sends a corresponding signal to the control device 10. The solenoid 6 of the magnetic rail brake 8 is also de-excited, because a magnetic rail brake deactivation signal is present at the control device 10 or because no magnetic rail brake activation signal has been triggered previously in the control device 10. This state exists just before the moment t1 in relation to the graphs of FIG. 2 and FIG. 3.

If then, at the moment t1, a fundamental magnetic rail brake activation signal is triggered in the control device 10 by a safety loop of the rail vehicle, for example in an emergency brake scenario, the switch is thus controlled by the control device 10 into the closed position of the switch, and the solenoid 6 of the magnetic rail brake 8 is thus initially acted on in a lasting manner by a voltage U of 110 V for example, as is clear from FIG. 2. This voltage produces a current I in the solenoid 6 in a slightly time-delayed manner, the current thus building up to approximately 10 A during the connection period, in which the solenoid 6 is connected to the source of electrical energy 2 by the switch 12, that is to say in the period of time between t1 and t2, as shown in FIG. 3. Since the speed of the rail vehicle at the moment t1 of activation of the magnetic rail brake is greater than the upper limit speed, the solenoid 6 is acted on the by the voltage U in a lasting manner. There may be no cyclical timing.

It is then assumed that, in the period of time between t1 (activation of the magnetic rail brake) and a moment t2 at which the magnetic rail brake activation signal is no longer present or a magnetic rail brake deactivation signal is generated or formed (deactivation of the magnetic rail brake), the speed of the rail vehicle has fallen to a speed that is between the lower and the upper limit speed, for example 30 km/h.

The moment t2 therefore marks the moment at which the magnetic rail brake deactivation signal is present or the magnetic rail brake activation signal is no longer preset. At the time t2, the solenoid 6 is therefore disconnected from the source of electrical energy 2 by the switch 12, which to this end is actuated accordingly by the algorithm of the control device 10.

Following a disconnection period between t2 and t3, the switch 12 is controlled again into the closed position at the moment t3, whereby a voltage U, e.g., of the same level, is again applied to the solenoid 6 during a connection period between t3 and t4. In this way, cycles of disconnection or connection of the solenoid 6 from or to the source of electrical energy 2 are produced until a moment t5, at which the switch is switched for the last time into the disconnection position to disconnect the solenoid 6 finally from the source of electrical energy 2 and to therefore de-excite the solenoid. At the moment t5, the rail vehicle is then already at standstill and is held in the braked state, for example by a parking brake, for which reason there is no need for the magnetic rail brake 8 to be held in an engaged state.

Here, the disconnection periods, in which the electrical connection 4 between solenoid and source of electrical energy 2 is disconnected, become longer in the time window between t2 and t5 over time t, and the connection periods, in which this electrical connection 4 is established, become shorter, as shown in particular by the voltage curve of FIG. 2. The course of current over time is then represented by a sawtooth-like profile, as shown in FIG. 3, caused by a certain time delay.

Here, the period P1 of cycles of establishment of the electrical connection 4 and the period PN of cycles of disconnection of the electrical connection 4 may be constant in each case and for example of identical magnitude. Alternatively, the period P1 and the period PN can be varied in each case, in particular to avoid a vibration excitation in the resonance range. The period P1/PN of a connection/disconnection cycle may vary here for example from 50 to 2000 ms.

To summarize, in the case of the example of FIG. 2 and FIG. 3, upon a magnetic rail brake activation signal at the connection or switch-on moment t1, and upon the following magnetic rail brake deactivation signal at the disconnection of switch-off moment t1, the exciting current is switched off, on, and off again cyclically by the switch 12 over a defined period of time (t2 to t5) until the last and final disconnection or switch-off moment t5, at which the rail vehicle for example has just come to standstill. The brake release jerk produced upon the magnetic rail brake deactivation signal due to the fundamental deactivation of the magnetic rail brake 8 is thus limited.

In the example of FIG. 2 and FIG. 3, the case in which the travelling rail vehicle is (also) braked by the magnetic rail brake 8 is therefore considered.

Furthermore, the case in which the magnetic rail brake 8 is actuated in the case of a rail vehicle travelling at a speed greater than the lower limit speed and below the upper limit speed (magnetic rail brake activation signal), whereby an undesirable brake engagement jerk would be produced, is conceivable.

Then, to reduce the brake engagement jerk or to avoid this, the connection between the source of electrical energy and the solenoid of the magnetic rail brake 8 is also established and disconnected again in a fixed sequence of cycles, as has already been described above. In this case, the disconnection periods, in which the electrical connection 4 between solenoid 6 and source of electrical energy 2 is disconnected, may become shorter upon the magnetic rail brake activation signal over time t, and the connection periods, in which this electrical connection 4 is established, may become longer.

The above-described embodiments can be applied not only with purely electric magnetic rail brakes 8 or magnetic rail brake devices 1. It can also be applied with electrically switchable permanent magnetic rail brakes to generate a magnetic counterfield to cancel the braking force effect.

LIST OF REFERENCE SIGNS

1 magnetic rail brake device
2 energy source
4 electrical connection
6 solenoid
8 magnetic rail brake
10 control device
12 switch
14 speed sensor
16 signal line
18 signal line
20 brake control plane

The invention claimed is:

1. A method for controlling a magnetic rail brake device of a rail vehicle, which device contains at least one solenoid of a magnetic rail brake, the solenoid being fed from a source of electrical energy via an electrical connection, the method comprising:

in response to a magnetic rail brake activation signal, establishing the electrical connection between the source of electrical energy and the at least one solenoid of the magnetic rail brake; and in response to a magnetic rail brake deactivation signal, disconnecting the connection to excite the at least one solenoid to generate a magnetic force or to de-excite the at least one solenoid, wherein once established, the electrical connection between the source of electrical energy and the at least one solenoid of the magnetic rail brake is disconnected and re-established in a fixed sequence of cycles, or once disconnected, the electrical connection between the source of electrical energy and the at least one solenoid of the magnetic rail brake is established and disconnected again in a fixed sequence of cycles.

2. The method of claim 1, further comprising evaluating a speed signal representing the speed of the rail vehicle to determine whether, at the moment of generation of the magnetic rail brake activation signal or of the magnetic rail brake deactivation signal, the speed of the rail vehicle is between a lower limit speed and an upper limit speed, and, if this is the case:

a) the electrical connection between the source of electrical energy and the at least one solenoid of the magnetic rail brake, once established, is disconnected and re-established in the fixed sequence of cycles, and, if this is not the case: the electrical connection, once established, is maintained at least until standstill of the rail vehicle, or b) the electrical connection between the source of electrical energy and the at least one solenoid of the magnetic rail brake, once disconnected, is established and disconnected again in the fixed sequence of cycles, and, if this is not the case: the disconnection of the electrical connection, once disconnected, is maintained.

3. The method of claim 1, wherein the electrical connection between the source of electrical energy and the at least one solenoid of the magnetic rail brake is disconnected and re-established or established and disconnected again respectively in the fixed sequence of cycles over a predefined period of time.

4. The method of claim 1, wherein a period of cycles of establishment of the electrical connection and a period of cycles of disconnection of the electrical connection is held constant in each case.

5. The method claim 1, wherein a period of cycles of establishment of the electrical connection and a period of cycles of disconnection of the electrical connection is varied in each case.

6. The method of claim 1, wherein, upon the magnetic rail brake activation signal, the disconnection periods, in which the electrical connection is disconnected, become shorter over time, and the connection periods, in which the electrical connection is established, become longer.

7. The method of claim 1, wherein upon the magnetic rail brake deactivation signal, the disconnection periods, in which the electrical connection is disconnected, become longer over time, and the connection periods, in which the electrical connection is established, become shorter.

8. The method of claim 1, wherein the magnetic rail brake activation signal is an emergency, rapid, enforced or service brake signal.

9. A magnetic rail brake device of a rail vehicle, the device comprising:

at least one solenoid of a magnetic rail brake, the solenoid being fed from a source of electrical energy via an electrical connection; and an electronic control device, wherein, in response to a magnetic rail brake activation signal triggered in the control device, the electrical connection between the source of electrical energy and the at least one solenoid of the magnetic rail brake is established and, wherein, in response to a magnetic rail brake deactivation signal triggered in the control device, the connection is disconnected to excite the at least one solenoid to generate a magnetic force or to de-excite said at least one solenoid, and wherein at least one switch is arranged in the electrical connection between the source of electrical energy and the at least one solenoid of the magnetic rail brake and is actuated by the control device in such a way that:

in response to the magnetic rail brake activation signal, the electrical connection between the source of electrical energy and the at least one solenoid of the magnetic rail brake, once established, is disconnected and re-established in a fixed sequence of cycles, or in response to the magnetic rail brake deactivation signal, the electrical connection between the source of electrical energy and the at least one solenoid of the magnetic rail brake, once disconnected, is established and disconnected again in a fixed sequence of cycles.

10. The magnetic rail brake device of claim 9, wherein the electronic control device evaluates at least one speed signal representing the speed of the rail vehicle to determine whether the speed of the rail vehicle, at the moment of generation of the magnetic rail brake activation signal or of the magnetic rail brake deactivation signal, is between a lower limit speed and an upper limit speed, and, if this is the case:

the switch is actuated by the control device in such a way that the electrical connection between the source of electrical energy and the at least one solenoid of the magnetic rail brake, once established, is disconnected and re-established in the fixed sequence of cycles, and, if this is not the case: the switch is actuated by the control device in such a way that the electrical connection, once established, is maintained at least until standstill of the rail vehicle, or the switch is actuated by the control device in such a way that the electrical connection between the source of electrical energy and the at least one solenoid of the magnetic rail brake, once disconnected, is established and disconnected again in the fixed sequence of cycles, and, if this is not the case: the switch is actuated by the control device in such a way that the disconnection of the electrical connection, once disconnected, is maintained.

11. The magnetic rail brake device of claim 9, wherein the control device actuates the switch in such a way that the electrical connection between the source of electrical energy and the at least one solenoid of the magnetic rail brake, once produced, or the electrical connection between the source of electrical energy and the at least one solenoid of the magnetic rail brake, once disconnected, is disconnected and re-established or is established and disconnected again respectively in the fixed sequence of cycles over a predefined period of time.

12. The magnetic rail brake device of claim 9, wherein the control device actuates the switch in such a way that a period of cycles of establishment of the electrical connection and a period of cycles of disconnection of the electrical connection is constant in each case.

13. The magnetic rail brake device of claim 9, wherein the control device actuates the switch in such a way that a period of cycles of establishment of the electrical connection and a period of cycles of disconnection of the electrical connection is varied in each case.

14. The magnetic rail brake device of claim 9, wherein the control device actuates the switch in such a way that, upon the magnetic rail brake activation signal, the disconnection periods, in which the electrical connection is disconnected, become shorter over time, and the connection periods, in which the electrical connection is established, become longer.

15. The magnetic rail brake device of claim 9, wherein the control device actuates the switch in such a way that, upon the magnetic rail brake deactivation signal, the disconnection periods, in which the electrical connection is disconnected, become longer over time, and the connection periods, in which the electrical connection is established, become shorter.

16. The magnetic rail brake device of claim 9, wherein the magnetic rail brake activation signal is an emergency, enforced, rapid or service brake signal triggered in the control device.

17. The magnetic rail brake device of claim 9, wherein the switch is an electrical or electronic switch, which is controlled electrically by the control device.

18. The magnetic rail brake device of claim 9, wherein, upon the magnetic rail brake activation signal, the control device performs the fixed sequence of cycles of disconnection and re-establishment of the electrical connection only once.

19. The magnetic rail brake device of claim 9, wherein, upon the magnetic rail brake deactivation signal, the control device performs the fixed sequence of cycles of re-establishment and disconnection of the electrical connection only once.

20. An Eddy current brake system of a rail vehicle, wherein the system contains a magnetic rail brake device as claimed in claim 9.

* * * * *